United States Patent [19]

Gazzarrini

[11] Patent Number: 4,485,749

[45] Date of Patent: Dec. 4, 1984

[54] CONTROL DEVICE FOR CONTROLLING THE APPLICATION OF A GUSSET TO A TUBULAR ARTICLE

[75] Inventor: Vinicio Gazzarrini, Tavarnuzze, Italy

[73] Assignee: Solis S.r.l., Tavarnuzze, Italy

[21] Appl. No.: 391,701

[22] Filed: Jun. 24, 1982

[51] Int. Cl.[3] ..... D05B 21/00; D05B 3/12

[52] U.S. Cl. ..... 112/121.12; 112/121.15; 112/104

[58] Field of Search ..... 112/121.12, 121.11, 112/121.15, 2, 121.29

[56] References Cited

U.S. PATENT DOCUMENTS 4,220,104 9/1980 Humphreys ..... 112/121.15 X 4,364,320 12/1982 Nakhle et al. ..... 112/121.15 X

FOREIGN PATENT DOCUMENTS 462086 4/1978 Spain ..... 112/121.15

*Primary Examiner*—H. Hampton Hunter

*Attorney, Agent, or Firm*—McAulay, Fields, Fisher, Goldstein & Nissen

[57] ABSTRACT

Control device for use with a carrousel-type machine for applying a gusset to a pantyhose article. The control device senses the presence of the pantyhose article on a support and then transfers the gusset to the pantyhose article when it is on the support. A photocell reader is also provided to control the sewing of the gusset to the pantyhose article and assure that sewing takes place over an angle greater than 360°.

9 Claims, 2 Drawing Figures

CONTROL DEVICE FOR CONTROLLING THE APPLICATION OF A GUSSET TO A TUBULAR ARTICLE

BACKGROUND OF THE INVENTION

Field of the Invention

This invention relates to a control device for controlling the application of a gusset to a tubular article.

More particularly, the present invention is concerned with a carrousel-type machine for applying a gusset or patch to a tubular article, such as a pantyhose for women, and in particular to operational control devices for a carrousel-type machine.

The invention is primarily concerned with a control device for controlling the feeding of a gusset to the article and checking the presence of the article so that sewing takes place at the sewing station only when the gusset and article are present.

CROSS REFERENCE TO RELATED APPLICATIONS

This invention is related to my co-pending U.S. Patent Application Ser. No. 107,426 filed on Dec. 26, 1979, and Application Ser. No. 362,974 filed Mar. 29, 1982.

Reference is also made to my co-pending application Ser. No. 055,261 filed July 6, 1979, and Application Ser. No. 218,911, filed Dec. 22, 1980, now Patent No. 4,413,575. All of the aforesaid applications are incorporated herein by reference.

My co-pending application Ser. No. 107,426, discloses a machine for attaching a gusset to pantyhose or ladies's tights, which includes a hollow frusto-conical support adapted to hold and stretch the non-sewn crotch region while the rest of the article is retained in an inside-out attitude inside the support. Below this support, a plate is adapted to bring the gusset opposite the unsewn edge of the article, after which a mechanical cloth cutter trims the cloth of the manufactured article and of the gusset so as to remove parts projecting from the sewing line, all during a complete rotation of the support (i.e. a line along which a seam is sewn or is to be sewn to stitch the gusset to the remainder of the garment).

My co-pending application Ser. No. 218,911 is concerned with a device for trimming an edge of a tubular article to form a portion of a pantyhose prior to the sewing of the gusset. A support is provided which is rotatable about its vertically disposed central axis and cooperates with a mask supported independently of the support and normally stationary. The mask has slots with which trimmers in the form of electrical heating elements cooperate. Each of the trimmers are movable independently of the other relative to the mask. The support is rotated relative to the mask and one of the trimmers penetrates and cuts the cloth by heat action and enters one of the slots in the mask so that during continued rotation of the support an edge of the article is trimmed from the remainder by the aforesaid trimmers to remain engaged about the support as an annular band. Rotation of the support is then stopped and the other trimmer is extended towards the mask to penetrate the annular band and enter the other slot to sever the annular band by heat action and convert the band into an elongate ribbon which is then drawn off into a suction duct having a mouth mounted for movement with the other trimmer.

DESCRIPTION OF THE PRIOR ART

The inventor of the subject matter of the present invention has provided a carrousel-type machine for applying a gusset to pantyhose, in particular women's pantyhose.

In one such apparatus which forms the subject matter of U.S. Patent Application Ser. No. 055,261, filed July 6, 1979 and Ser. No. 218,911, filed Dec. 22, 1980, there is disclosed an apparatus which includes a first station which is provided for the positioning of a pantyhose article without a gusset under tension by stretching of the edge of an unsewn zone to receive the gussets on an annular support, a second station is provided for pneumatically turning over of the article inside the support, a third station is provided for placing the patch or gusset in position underlying the stretched edge of the article, a fourth station is provided for smoothing of the patch or gusset and of the stretched edge of the article and cutting of the portions of fabric exceeding the sewing line; and a fifth station is provided for sewing the patch or gusset to the article.

At the third station, there is provided a device for the formation of gussets or patches from a continuous band. The gusset formation device is always in operation and the device to place a gusset on the support pantyhose for the article is always in operation regardless of whether or not the support is provided with the pantyhose article, so that in the absence of the pantyhose article, the patch or gusset is fed even though there is no pantyhose article and hence not utilized and is wasted.

SUMMARY OF THE INVENTION

It is therefore an object of the invention to provide a control device for controlling the application of a gusset or patch to a pantyhose article.

Another object of the invention is to prevent the wastage of gusset material in the aforedescribed carrousel-type of machine and to operate the control of the rotation gusset or of the patch together with the article, in a smoothing station, through an angle greater than 360° so that the front side of the gusset or patch will, in the next sewing station, be in a different position from that of arrival in the smoothing station and therefore more suitable for the start of sewing with a patch of square form.

The rotation is preferably $360°+180°$ ; and with a gusset or patch of polygonal form of n sides the angle of rotation will preferably be $360°+360°/n$. Rotation for over 360° is preferred to effect a trimming of the pantyhose when making a cold cut with mechanical means. Further, the control of the rotation of the article and of the patch, at the sewing station, through an angle greater than 360° may be made to assure a continuous sewing along the entire perimeter edge or boundary of the article.

These results are achieved in accordance with the teachings of the invention by providing the machine, at the smoothing station or at a preceding station, with a device capable of revealing or indicating the presence of the article and with the further function of allowing the pincer to transfer the gusset or patch onto the gusset- or patch-carrying plate under the pantyhose article only when the article is present. Further, at the smoothing and sewing stations, respectively, there is provided a device capable of controlling the rotation to which the support of the article is subjected in the smoothing phase and in the sewing phase, respectively, and with the further function of controlling the stopping of the support upon completion of angular rotation corresponding to that pre-established and stored in the memory of the device in accordance with the outer configurations of the gusset.

A feature of the present invention is that the band of fabric for the formation of the gussets or patches is used completely and hence without any waste. Another feature of the invention is that the sewing of the patch or gusset is without defects, uninterrupted and continuous over the entire perimeter edge of the article. Moreover, another feature is that the sewing of the patch or gusset is executed and carried out exactly the same for all articles.

To these ends, the present invention consists in the provision of a control device for a carrousel-type machine for applying a gusset to a pantyhose article, the machine having a rotatable support adapted for having a pantyhose article applied thereto and the control device comprises means for verifying the presence or absence of the pantyhose article on the support; and means for reading a cylindrical, uniform graduation integral with the support.

The verifying means is provided at a gusset feeding station of the machine. Alternatively, the verifying means can be provided at a station preceding the gusset feeding station of the machine. The verifying means, which is a photocell, controls a pincer of the carrousel-type machine for transferring the gusset only when the article is present on the support.

The cylindrical uniform graduation integral with the support includes several equal, equidistant divisions on a cylindrical collar secured on the support for identification by the reading means. The reading means which is an electronic reader is provided at a smoothing station and a sewing station of the machine.

The plurality equidistant divisions is provided on the rotatable support, and the reading includes an electronic reader having a memory for comparing the number of equidistant divisions through which the rotatable support rotates and means for stopping rotations of the rotatable support when the angular rotations thereof exceed 360°, and corresponding to the number of divisions of the memory.

Accordingly, with the present invention, the gusset is applied to the article or woman's pantyhose, at the gusset applying station only if the article is present on the respective support. For this purpose, a device such as a photocell is used for checking the presence of the pantyhose so that the feeding of the gusset only takes place when the pantyhose article is present.

For the purpose of rotating the gusset and the article, in the corresponding smoothing station, by an angle greater than the round angle so that the side of the gusset will, in the next sewing station, be in a different position from that of its arrival at the smoothing station, a control is used to control the rotation of the support for the article. The control device is a reading device which is capable of reading uniform cylindrical graduation and is provided with a programmed memory which causes the rotation of the support to be stopped after the completion of a rotation corresponding to the graduation stored in memory. The article support is provided with graduations which is read by the reading device, and after the pre-determined number of graduations stored in the memory, the article support is stopped from rotating.

In order to rotate the gusset and the article, in the corresponding sewing station, by an angle greater than the round angle so that the stitching will be executed on the entire edge of the article without interruption, a control device equal to the aforesaid is used in the smoothing station.

Other objects, advantages and the nature of the invention will become readily apparent from the detailed description of the invention taken in connection with the accompanying drawings.

DESCRIPTION OF THE PREFERRED EMBODIMENTS

Figure 1:
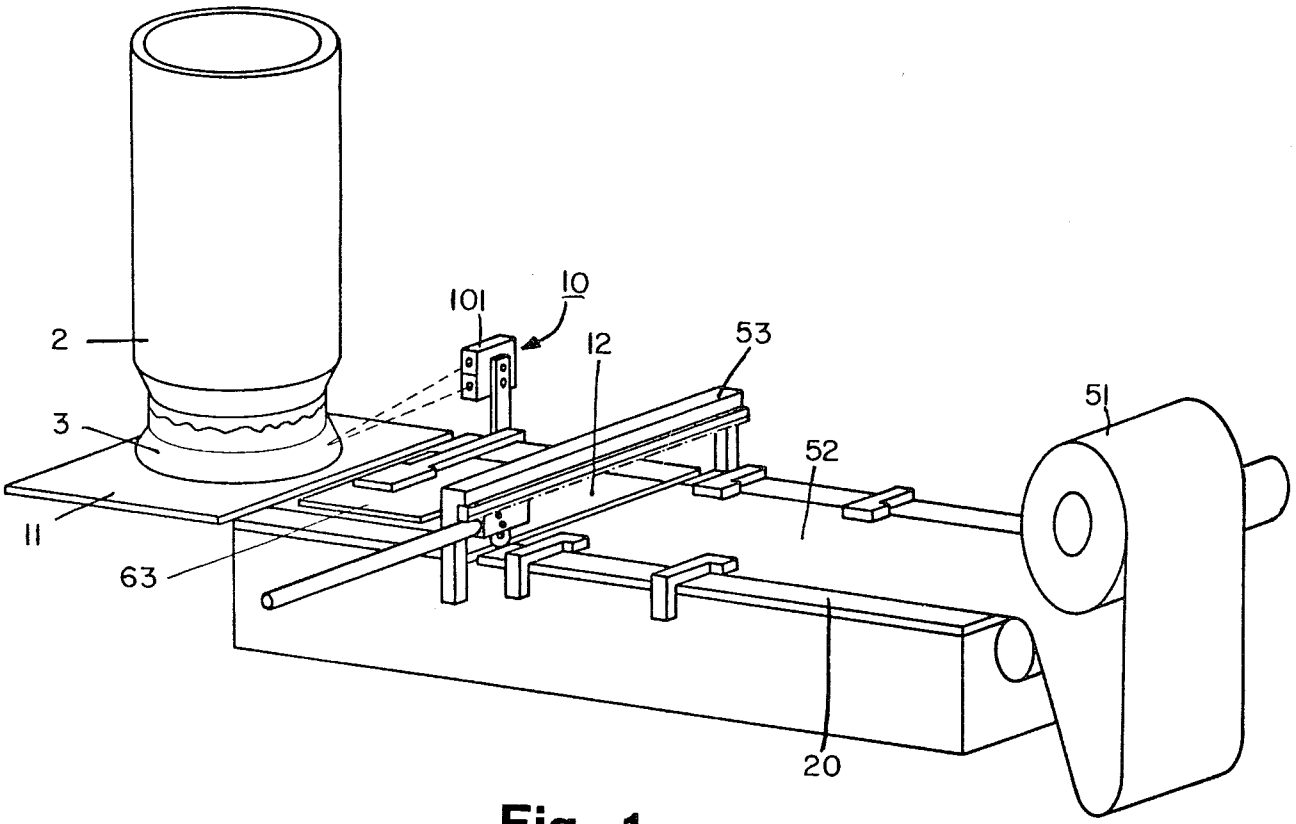
FIG. 1 is a schematic perspective view of a control device according to the invention.

Referring now more particularly to the drawings which illustrate the presently preferred mode of carrying out the invention, and in particular to FIG. 1 which illustrates a sensing control device 10 for sensing the presence of a gusset or patch 12 in the gusset feeding phase. A roll of gusset material 51 is provided for supplying patch 12 which is cut from a band 52 extending from roll 51 and fed by conventional conveyor means 20 to pantyhose article support 2 for holding thereto the pantyhose article 3.

The control device 10 includes a photocell 101 whose purpose is to sense the presence of article 3 on support 2. Pincer 63 is provided to transfer gusset 12 after it has been severed from band 52 by a conventional cutting device 53 to a plate 11 in juxtaposition to article 3.

Pincer 63 is operatively controlled by photocell 101 to transfer gusset 12 to plate 11 only when photocell 101 indicates the presence of article 3 on support 2.

Figure 2:
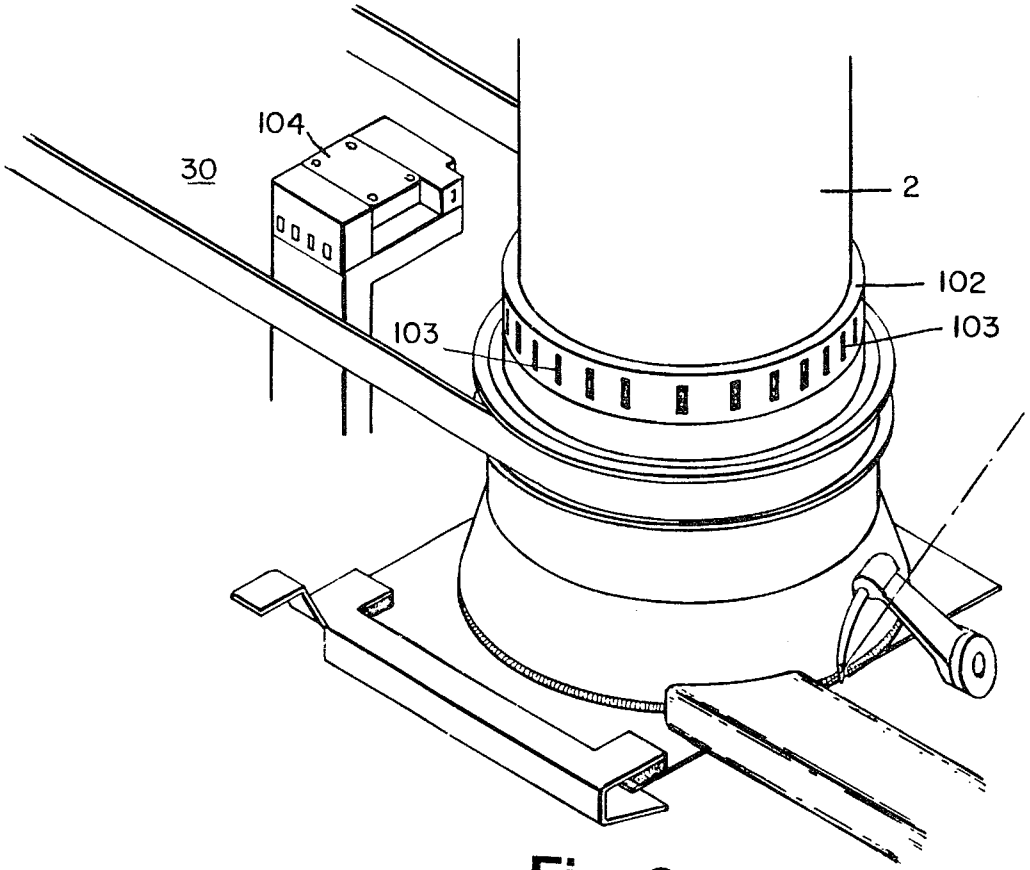
FIG. 2 is a perspective view of the control for rotation of the article support device and the article thereon.

Referring now more particularly to FIG. 2 which illustrates an angular rotation control device 30 for controlling the angular rotation of support 2. Angular rotation control device 30 includes a graduated collar 102 secured to or mounted onto support 2 and a reading device 104.

Graduated collar 102 is generally cylindrically-shaped and surrounds article support 2 and is provided with several equal, rectilinear and equidistant divisions or graduations 103 all of which are parallel to the longitudinal axis of support 2 for article 3. Reading device 104 includes a conventional electronic detector or reader for reading graduations 103. Reading device 104 also includes a memory suitably arranged to read a predetermined number of divisions or graduations 103 and includes conventional means to control and command the stopping of the rotation of support 2 as soon as support 2 is rotated through an angle greater than 360° past the front of reading device 104 which corresponds to the number of graduations stored in the memory of device 104.

OPERATION OF THE INVENTION

The photocell 101 verifies the presence or absence of the article 3 on the respective support 2 and electronic device 104 reads the cylindrical, uniform graduation integral with the support 2. The photocell 101 is provided at the gusset-feeding station or at another preceding station. The photocell controls means suitable for allowing the active course or stroke of pincer which transfers the gusset 12 only when the article 3 is present on support 2. The graduations on support 2 consist of several equal, equidistant divisions 103 on cylindrical collar 102 which is secured on the support 2 for identification by reading device 104.

The reading device 104 is provided with a memory which is capable of comparing the number of divisions 103 by which the support 2 rotates and to cause the stoppage of support 2 upon completion of an angular rotation corresponding to the number of divisions of the memory which is greater than an angle of 360°. The reading device 103 is provided at the smoothing station and the sewing station.

While there has been shown and described what is considered to be the preferred embodiment of the invention, it will be obvious to those skilled in the art that various changes and modifications may be made therein without departing from the scope of invention.

I claim:

1. A control device for a carrousel-type machine for applying a gusset to a pantyhose article, said carrousel-type machine having a rotatable support adapted for having a pantyhose article applied thereto, said control device comprising:

means for verifying the presence or absence of the pantyhose article on the support;

means for reading a cylindrical, uniform graduation integral with the support; and means responsive to said verifying means and said reading means for transferring the gusset to said support only when said verifying means indicates the presence of the panty hose article on said support and to insure that said support rotates through at least 360° so that the carousel-type machine is operable only when a gusset is in place and to insure the complete serving along the entire perimeter of the gusset.

2. The control device of claim 1, wherein said verifying means is provided at a gusset feeding station of the carrousel-type machine.

3. The device of claim 1, wherein said verifying means controls a pincer of the carrousel-type machine for transferring the gusset only when the article is present on the support.

4. The control device of claim 1, wherein the cylindrical uniform graduation integral with the support includes several equal, equidistant divisions on a cylindrical collar secured on the support for identification by said reading means.

5. The control device of claim 1, wherein said reading means is provided at a smoothing station and a sewing station of the machine.

6. The device of claim 1, wherein said verifying means is a photocell and said reading means is an electronic reader.

7. The device of claim 1, wherein a plurality equidistant divisions is provided on said rotatable support, and said reading means includes an electronic reader having a memory for comparing the number of equidistant divisions through which the rotatable support rotates and means for stopping rotations of said rotatable support when the angular rotations thereof exceed 360°, and corresponding to the number of divisions of said memory.

8. The device of claim 7, wherein, the gusset is of polygonal form having n sides, and said stopping means stops the rotation of the support after it has rotated through an angle of $360° + 360°/n$.

9. The device of claim 7, wherein the gusset has a square configuration, and said stopping means stops the rotations of the support after it has rotated through an angle of 360° plus 180°.

* * * * *